US007070049B2

(12) United States Patent
Lee et al.

(10) Patent No.: US 7,070,049 B2
(45) Date of Patent: Jul. 4, 2006

(54) OFFSET PRODUCT PACKAGE FOR SUSPENSION-TYPE DISPLAY

(75) Inventors: Barry H. Lee, Essex (GB); Richard J. Gruetzmacher, Colgate, WI (US); Timothy J. Wojciechowski, Hubertus, WI (US)

(73) Assignees: Johnson Level & Tool Mfg. Co., Inc., Mequon, WI (US); Fisco Tools Limited, Rayleigh (GB)

( * ) Notice: Subject to any disclaimer, the term of this patent is extended or adjusted under 35 U.S.C. 154(b) by 34 days.

(21) Appl. No.: 10/636,075

(22) Filed: Aug. 7, 2003

(65) Prior Publication Data

US 2005/0029147 A1 Feb. 10, 2005

(51) Int. Cl.
*A45C 11/26* (2006.01)

(52) U.S. Cl. ..... 206/349; 206/461; 206/493; 9/457

(58) Field of Classification Search ..... 206/349, 206/461, 462, 471, 493, 495; D9/457
See application file for complete search history.

(56) References Cited

U.S. PATENT DOCUMENTS 4,016,972 A * 4/1977 Szamborski ..... 206/6.1
4,175,660 A * 11/1979 Feibelman ..... 206/468
5,197,596 A * 3/1993 Garganese ..... 206/6.1
5,377,820 A * 1/1995 Christman ..... 206/6.1
5,803,253 A * 9/1998 Zakarian ..... 206/349
6,206,189 B1 * 3/2001 Huot et al. ..... 206/379
6,401,921 B1 * 6/2002 Usami ..... 206/349

* cited by examiner

*Primary Examiner*—David T. Fidei
(74) *Attorney, Agent, or Firm*—Boyle, Fredrickson, Newholm, Stein & Gratz, SC

(57) ABSTRACT

A suspension-type packaging arrangement for a product includes an upper engagement section having an opening to receive a hook or the like, a lower product support section, and an intermediate display section located between the upper engagement section and the lower product support section. The product is secured to the product support section, and is exposed to allow the user to handle the product so as to evaluate and test the product prior to purchase. The upper engagement section and the lower product support section are configured so that the center of gravity of the product is generally in line with the location at which the hook engages the upper engagement section, so that the packaging arrangement and the product hang in a generally vertical orientation for display. The intermediate display section is defined by an outwardly facing wall, and may be configured to releasably secure a display card containing product information that is visible to the potential purchaser. In a preferred form, the wall defining the intermediate section is formed of a translucent material, so as to enable the user to view information carried on both the front and the back surfaces of the display card.

18 Claims, 8 Drawing Sheets

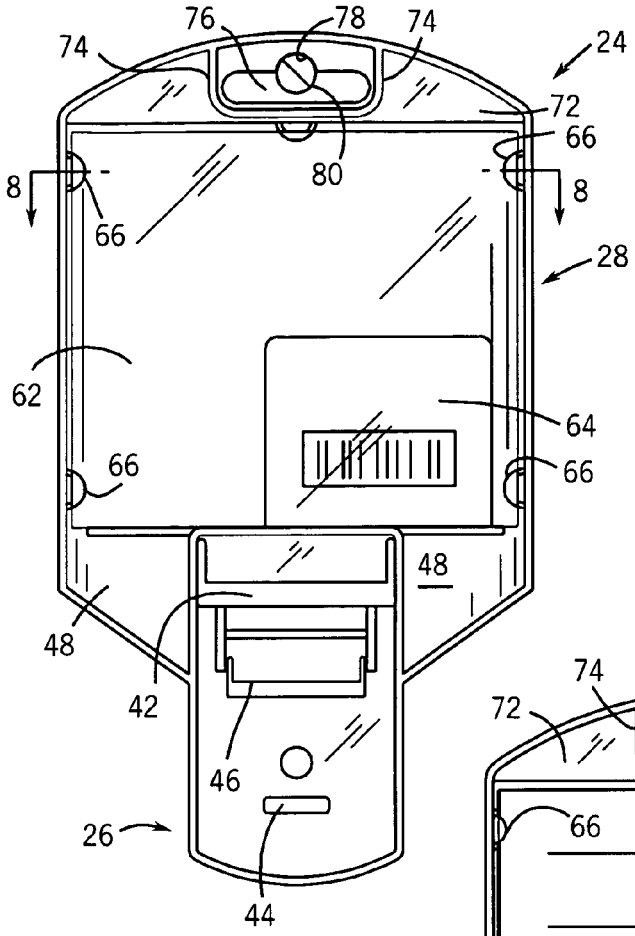
FIG. 6
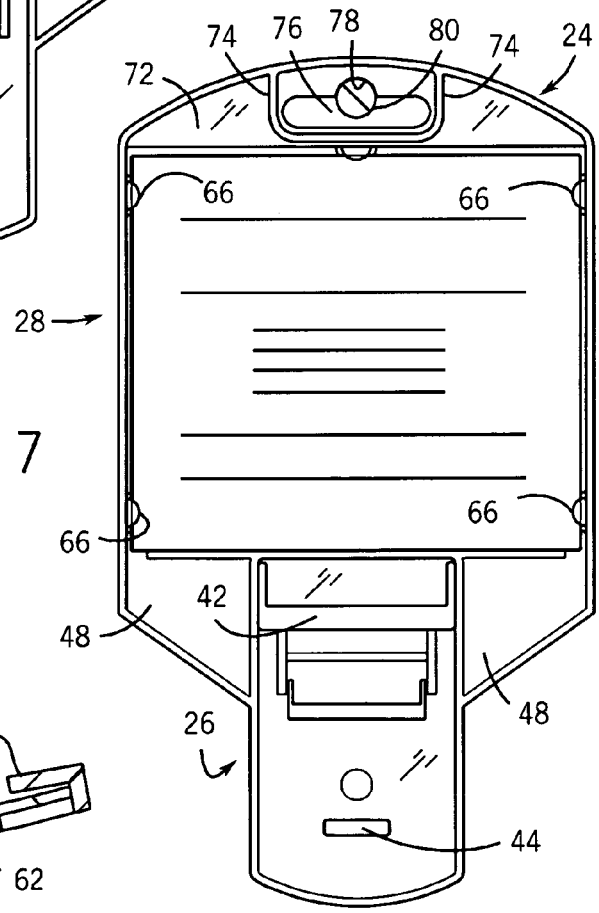
FIG. 7
FIG. 8
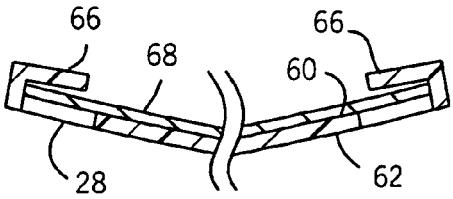

OFFSET PRODUCT PACKAGE FOR SUSPENSION-TYPE DISPLAY

BACKGROUND AND SUMMARY OF THE INVENTION

This invention relates to product packaging, and more particularly to a product package adapted for display in a suspension-type manner from a hook or the like.

Suspension-type product packages are well-known, and typically include an upper end area having an opening for receiving a hook, rod or the like that extends forwardly from a support, such as a vertical wall of a display. Typically, a suspension-type package is constructed such that the product is secured to a forwardly facing surface defined by a vertically oriented panel of the package, and the opening for the hook or the like is formed in an upper area of the panel. This configuration is well suited for relatively small or lightweight products. However, products that are relatively heavy, or which have a significant depth dimension, cannot be packaged this way since the weight of the product causes the package to hang at an angle when the package is engaged with the hook. That is, the bottom of the package is swings rearwardly under the weight of the product when the top area of the package is engaged with a display hook or the like. Typically, this problem is addressed by constructing the package in a manner such that the product is fully enclosed by the package to provide product support, and positioning the product relative to the package such that the center of gravity of the product is in line with the plane of the package. While this arrangement functions satisfactorily, it is disadvantageous in that the package entirely surrounds the product, which prevents the potential purchaser from handling the product in order to test product features or to otherwise obtain a feel for the product prior to purchase. In addition, this type of packaging requires the package to have an opening that is configured to receive the product, and also requires a separate element for maintaining the product in position relative to the panel.

It is an object of the present invention to provide a suspension-type packaging arrangement for a product, in which the product is positioned relative to the package in a manner that maintains the product and the package in a generally vertical orientation when the package is engaged with a display hook or the like. It is a further object of the invention to provide such a packaging arrangement which is capable of being used for many different types of products having various product configurations. It is another object of the invention to provide such a packaging arrangement having a display area for presenting information about the product, and which is at a location separate from the product support area of the package, so as to provide a consistent and uniform display for a family of differently configured products. Yet another object of the invention is to provide such a packaging arrangement in which the same package can be used to present display information unique to each type of product. Yet another object of the invention is to provide such a packaging arrangement which is relatively simple in its components and construction, and which is constructed and configured so as to provide relatively quick and easy securement of the product to the package. A still further object of the invention is to provide such a packaging arrangement in which the product is exposed, to enable a potential customer to handle the product prior to purchase, so as to enable the potential purchaser to make an informed purchasing decision. Yet another object of the invention is to provide a packaging arrangement that enables the products to be displayed in a high density fashion, to maximize the number of products that can be suspended from a display hook or the like.

These and other objects are accomplished by the present invention, which contemplates a product packaging arrangement that includes an upper engagement section, a lower product support section, and a display section located between the upper engagement section and the product support section. The upper engagement section includes engagement structure, such as an opening that is adapted to receive a hook or the like, to enable the product packaging arrangement to be suspended therefrom for display. The upper engagement section and the lower product support section are configured and arranged such that the hook or the like engages the upper engagement section in a location that is generally in vertical alignment with the center of gravity of the product that is supported by the product support section. In this manner, the packaging arrangement and the product are maintained in a generally vertical orientation when engaged with the hook or the like.

In one form, the lower product support section is offset rearwardly relatively to the upper engagement section. The intermediate display section, which is located between the upper engagement section and the lower product support section, is offset rearwardly from the upper engagement section and offset forwardly from the lower product support section. With this construction, the upper engagement section is located vertically above the product, to enable a number of products to be suspended from the hook or the like in a high density manner. The product support section includes a rear wall to which the product is secured, such that the product is suspended from the rear wall of the product support section and hangs downwardly therefrom. In this manner, substantially the entirety of the product is exposed, so as to enable potential purchasers to handle and test the product prior to purchase.

The display section of the product packaging arrangement is preferably in the form of an outwardly facing wall that bears information pertaining to the product. Representatively, the information may be carried by a card that is releasably secured to the outwardly facing wall. In a representative construction, the outwardly facing wall is formed to include a series of tabs, which are configured to engage the edges of the card so as to releasably maintain the card in engagement with the outwardly facing wall.

The packaging arrangement may be a one-piece member formed of a plastic material in an injection molded process, although it is understood that other satisfactory materials and forming processes may be employed. In a particularly preferred form, the plastic material is translucent, so that information on the card can be viewed from both the front and the back of the package. The packaging arrangement is especially well suited for packaging of hand tools, since it is desired to enable potential customers to fully view and handle products of this type prior to purchase. However, it is understood that the packaging arrangement of the present invention may be used to package other types of products.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 6 is a rear elevation view of the packaging arrangement of FIG. 1, without the product attached;

FIG. 7 is a front elevation view of the packaging arrangement of FIG. 1, without the product attached;

FIG. 8 is a section view taken along line 8—8 of FIG. 6;

DETAILED DESCRIPTION OF THE INVENTION

Figure 1:
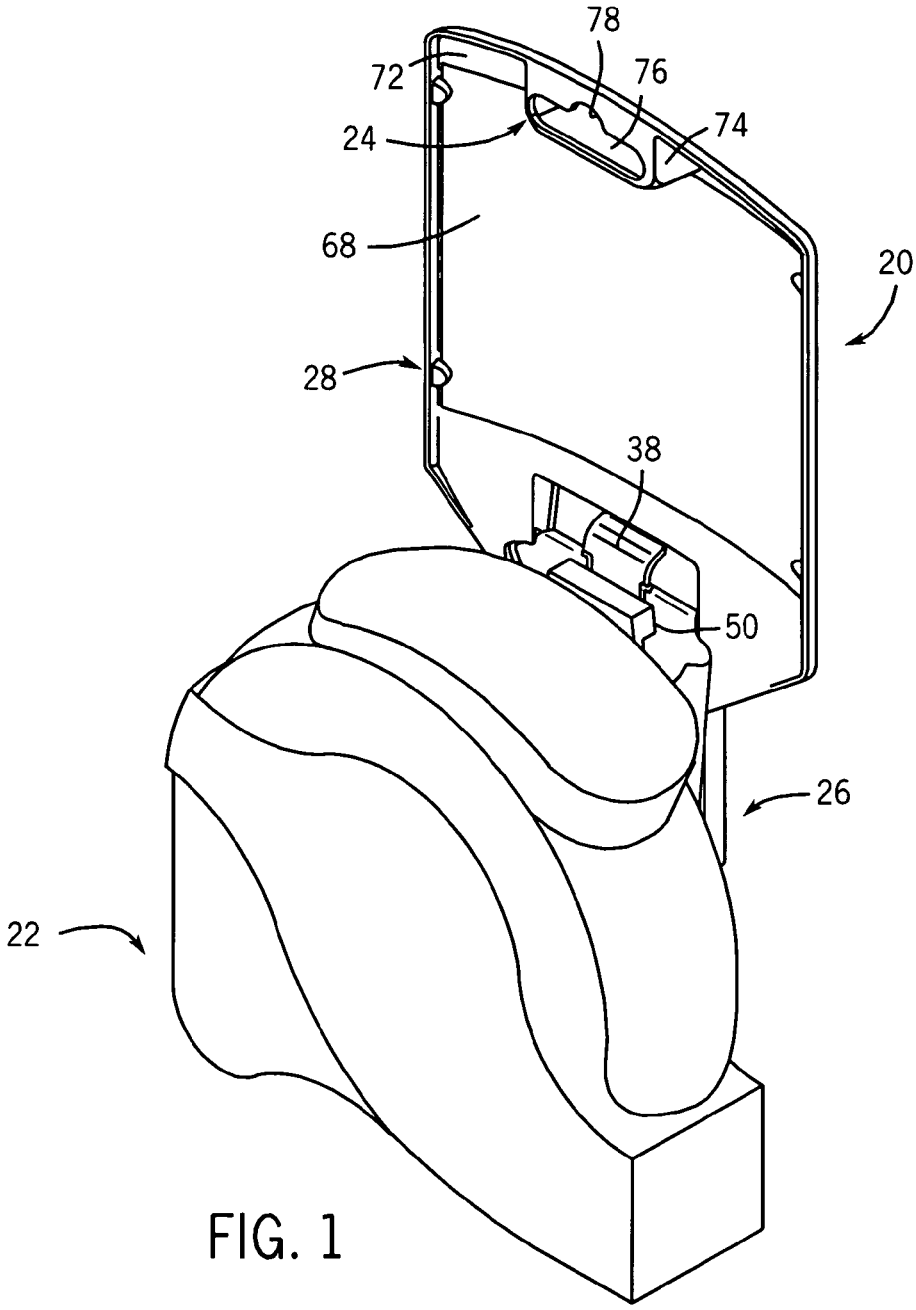
FIG. 1 is an isometric view of a product packaging arrangement in accordance with the present invention, showing the product attached to the packaging arrangement for display.
Figure 2:
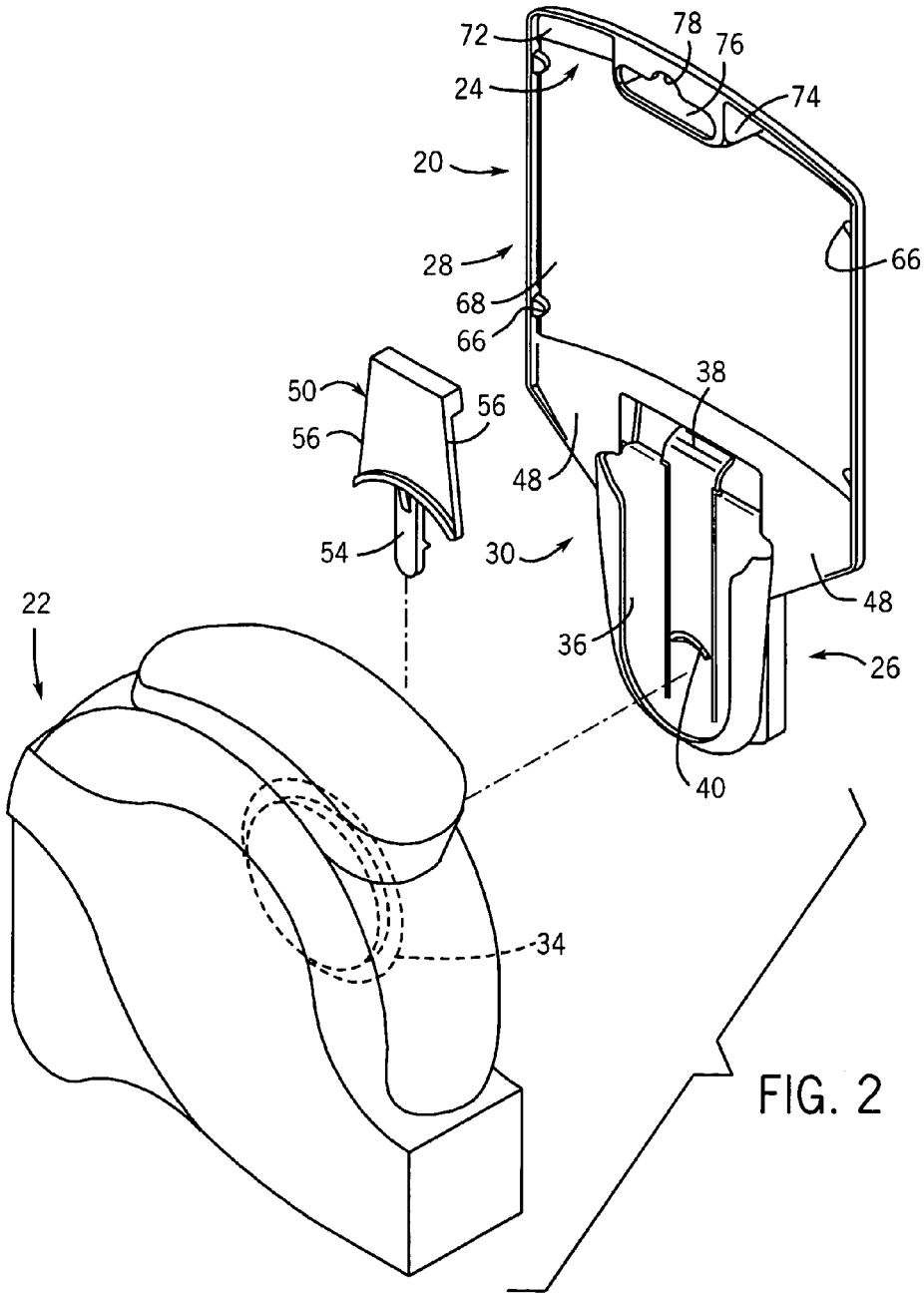
FIG. 2 is an exploded isometric view showing the packaging arrangement and the product of FIG. 1.
Figure 3:
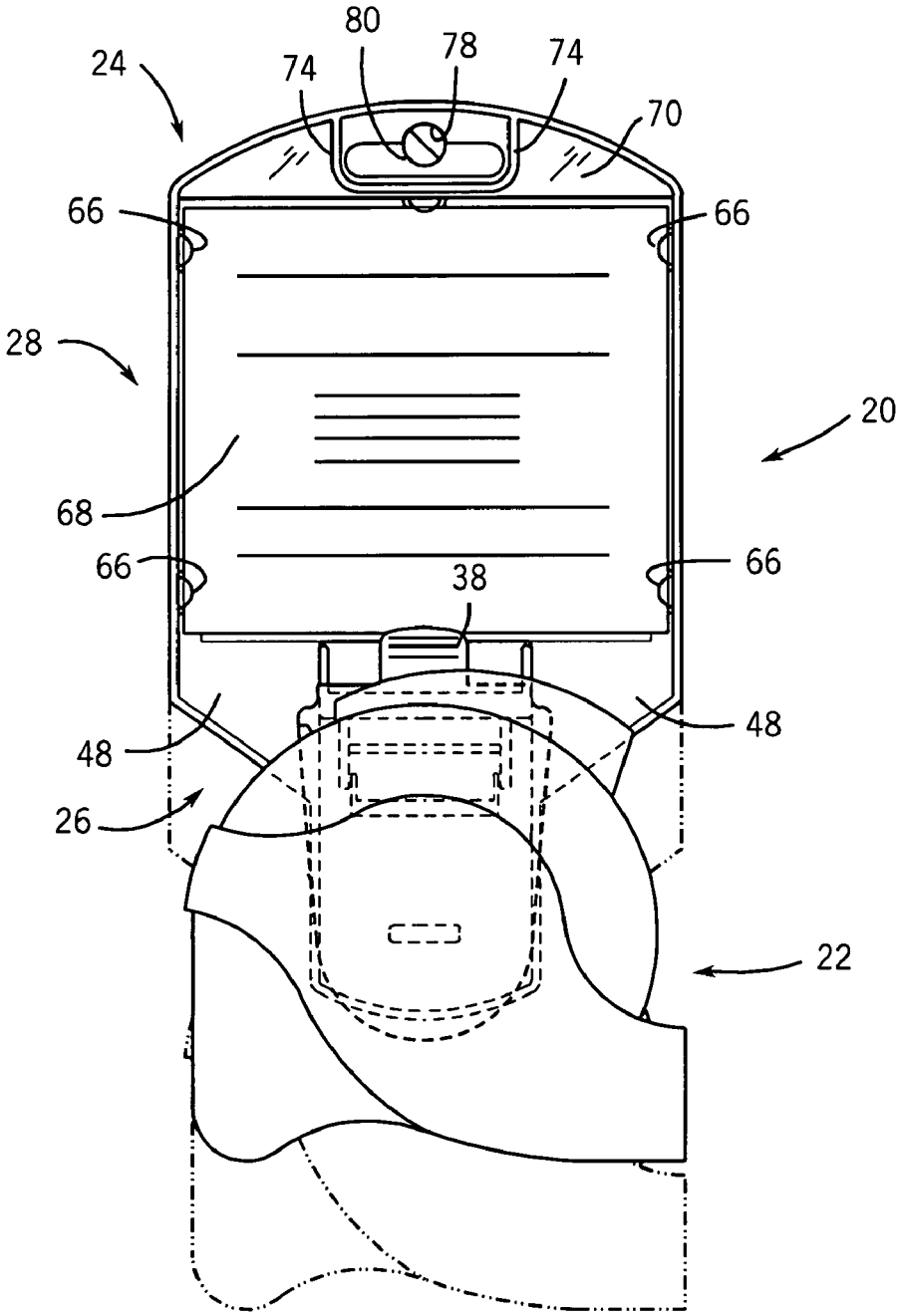
FIG. 3 is a front elevation view showing the packaging arrangement and the product of FIG. 1.

A packaging arrangement 20 for a product, which may be in the form of a tape measure 22, generally includes an upper engagement section 24, a lower product support section 26, and an intermediate display section 28 located between upper engagement section 24 and product support section 26. In a manner to be explained, tape measure 22 is secured to packaging arrangement 20, which is adapted for use in displaying tape measure 22 for retail sale.

In the illustrated embodiment, tape measure 22 has a belt clip 30 having a downwardly facing hook 32, and the body of tape measure 22 includes a button 34 that is received within a pocket 36 defined by belt clip 30 for removably engaging the body of tape measure 22 with belt clip 30. Belt clip 30 includes a lever 38 having an arcuate engagement member 40, and button 34 includes a groove that faces lever 38 and is configured to receive engagement member 40 so as to releasably engage the body of tape measure 22 with belt clip 30. The groove in button 34 is circular, such that tape measure 22 can be rotated a full 360° relative to belt clip 30. Details of the construction and operation of tape measure 22 and belt clip 30 are disclosed in copending application Ser. No. 10/626,606 filed Jul. 25, 2003 and PCT application No. PCT/GB02/03547 filed Aug. 1, 2002, the disclosures of which are hereby incorporated by reference.

Referring to FIGS. 6 and 7, lower product support section 26 extends downwardly from the lower end of intermediate display section 28, and is offset in a rearward direction relative to the lower end of display section 28. Lower product support section 26 includes an upper transverse slot 42, a lower transverse slot 44 and an intermediate transverse slot 46. In the illustrated embodiment, lower products support section 26 is centered along the width of the lower end of intermediate display section 28, and has a width less than that of intermediate display section 28. A pair of gusset wall sections 48 extend laterally outwardly between the edges of the upper end of lower product support section 26 and the lower edge of intermediate display section 28, to provide support for lower product support section 26.

To secure tape measure 22 to lower product support section 26, hook 32 of belt clip 30 is deflected in a rearward direction, and the lower end of hook 32 is inserted through upper transverse slot 4. Hook 32 is then moved downwardly so that belt clip 30 and the attached tape measure 22 attain the position as shown in FIGS. 1–4, wherein the upper end of hook 32 is disposed in slot 42. The lower end of hook 32 is positioned such that a forwardly extending protrusion formed on the lower end of hook 3 is received within lower slot 44 in product support section 26, to maintain belt clip 30, and thereby tape measure 22, in engagement with lower product support section 26.

It should be understood that the particular construction of lower product support section 26 as shown is illustrative, and that lower product support section 26 may have any other satisfactory configuration as desired. In addition, it should also be understood that the manner in tape measure 22 is engaged with product support section 26 is illustrative, and that the displayed product may be engaged with the product support section in any other satisfactory manner.

Figure 5:
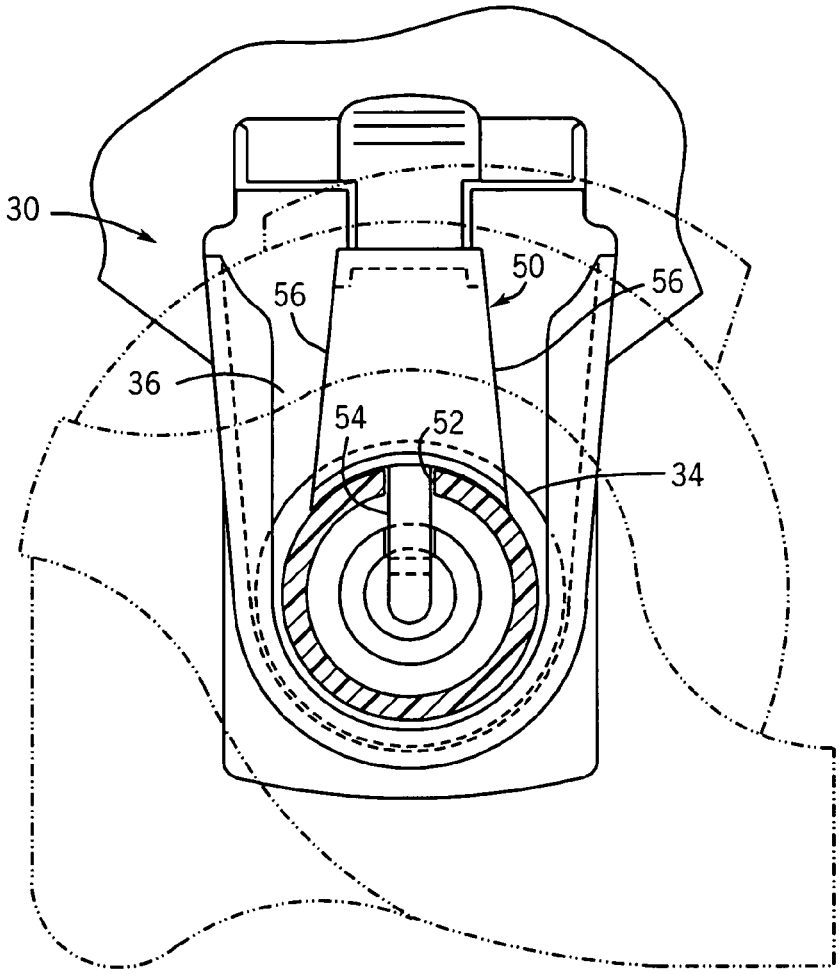
FIG. 5 is a partial section view taken along line 5—5 of FIG. 4.

Because tape measure 22 can be rotated relative to belt hook 30, and thereby relative to packaging arrangement 20, a removable anti-rotation member 50 (FIG. 5) is engaged with tape measure 22 so as to maintain tape measure 22 in a generally upright orientation for packaging and display. Button 34, which is located on the rear of tape measure 22, includes an upwardly facing opening 52 that communicates with an open interior defined by button 34. Anti-rotation member 50 has a projection 54 that extends through opening 52 into the interior of button 34, so as to releasably secure anti-rotation member 50 to tape measure 22. Anti-rotation member 50 rotates along with tape measure 22 relative to belt clip 30, and defines side edges 56 that engage the side walls of belt clip pocket 36 when tape measure 22 is rotated relative to belt clip 30, and thereby relative to packaging arrangement 22. In this manner tape measure 22 can be rotated throughout a relatively small arc of rotation when tape measure 22 is secured to packaging arrangement for display, to enable a potential customer to obtain a feel for the rotation feature of tape measure 22 relative to belt clip 30. However, the user cannot spin tape measure 22 completely through its full range of motion relative to belt clip 30, which ensures that tape measure 22 is maintained in a generally upright attitude for display. After purchase, the user simply removes anti-rotation member 50, and tape measure 22 can then be freely rotated relative to belt clip 30 as intended.

Intermediate display section 28 of packaging arrangement 22 defines a front surface 60 and a rear surface 62, and has a curved concave shape when viewed from front surface 60. Intermediate display section 28 is preferably formed of a translucent or transparent material. Representatively, the entirety of packaging arrangement 22 may be formed of a translucent thermoplastic material in an injection molding process, although it is understood that any other satisfactory material and forming method may be employed. When intermediate display section 28 is formed of a translucent material, a portion of intermediate display section 28 is formed to define a transparent window 64. Alternatively, intermediate display section 28 may be formed such that an opening is located in the area of window 64.

Intermediate display section 28 defines spaced apart side edges, and includes a series of tabs 66 that extend inwardly from the side edges. Each tab 66 is spaced from front surface 60 of intermediate display section 28. With this construction, a product information card 68 is engaged with intermediate display section 28. Card 68 defines front and rear surfaces, both of which bear information relative to the packaged product carried by packaging arrangement 22, in this case tape measure 22. Card 68 is constructed so as to have a shape that corresponds to that of intermediate display section 28, such that card 68 covers substantially the entire area of front surface 60 of intermediate display section 28. Tabs 66 engage the side edges of card 68, to maintain card 68 in engagement with the front surface of intermediate display section 68. The curve of intermediate display section 28 functions to maintain card 68 in a similar curvature, to maintain card 68 in engagement with the front surface 60 of intermediate section 28 when the sides of card 68 are engaged with tabs 66. Upper and lower ridges may be formed at the upper and lower edges, respectively, of intermediate display section 28 for maintaining card 68 in the desired position on front surface 60 of intermediate display section 28.

The front surface of card 68 is exposed, such that product information carried by the front surface of card 68 can easily be viewed by the potential purchaser. Product information on the rear surface of card 68 can be viewed through the material of intermediate display section 28, due to the translucence or transparency of the material of intermediate display section 28. The product UPC code is preferably carried by the rear surface of card 68, and is in alignment with window 64. In this manner, the transparency or openness of window 64 enables the UPC code to be scanned through the material of intermediate display section 28 at the time of purchase.

Alternatively, it is understood that intermediate display section 28 may be formed of an opaque material, and that the information carried on the front and/or rear surfaces of card 68 may also be applied directly to the surfaces of intermediate display section 28

Upper engagement section 24 of packaging arrangement 20 includes a forwardly angled top wall 70 that extends from the upper end of intermediate display section 28. At a central location along the width of top wall 70, upper engagement section 24 includes a vertical engagement wall 72 and a pair of side walls 74 located one on either side of engagement wall 72. An opening 76 is formed in engagement wall 72, and includes an upwardly extending recess 78.

Figure 4:
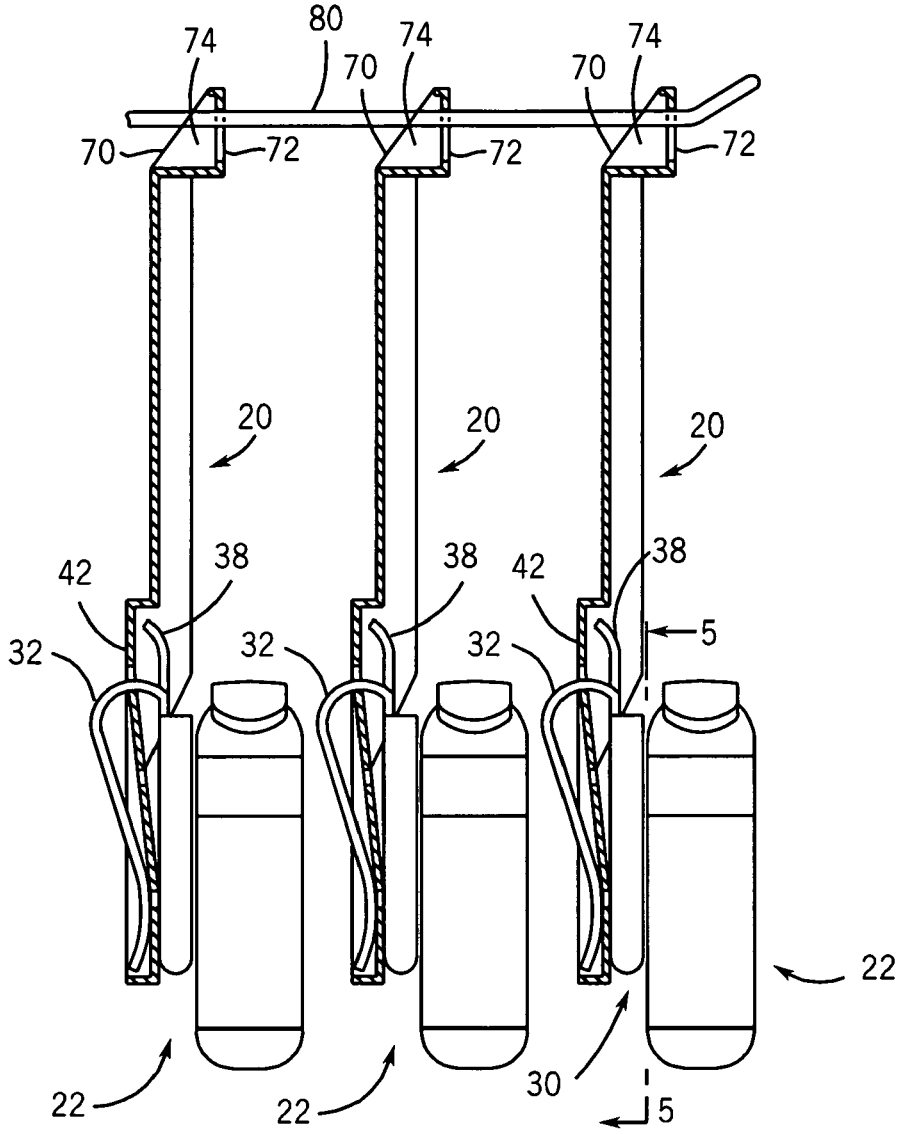
FIG. 4 is a side elevation view showing a series of packaging arrangements as in FIG. 1, suspended from a hook or the like for display of a number of products.

Upper engagement section 24 is formed so as to extend forwardly from intermediate display section 28, and is configured such that opening 76 is in a forwardmost location on packaging arrangement 20. In a particularly preferred construction opening 76 is located so as to be in alignment with a center of gravity of the packaged product. In this manner, when packaging arrangement 20 is engaged with a display hook, such as shown at 80 in FIG. 4, the packaging arrangement 20 and the packaged product, i.e. tape measure 22, hang in a generally vertical orientation for display. As also shown in FIG. 4, packaging arrangement 20 has an overall depth less than that of the packaged product and is engaged with the product such that the entire cross-sectional depth of packaging arrangement 20 is contained within an envelope defined by the depth of the packaged product. With this construction, packaging arrangement 20 provides maximum density of the number of products that can be displayed on hook 80.

Figure 9:
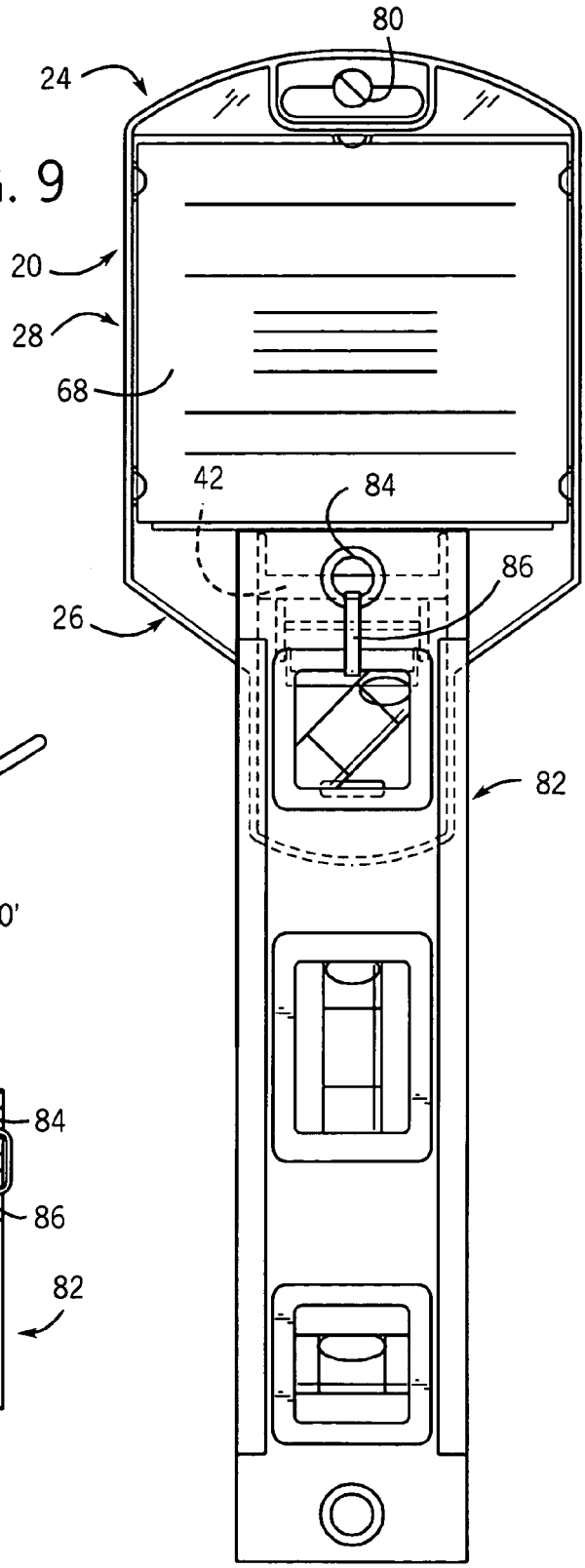
FIG. 9 is a view similar to FIG. 3, showing the packaging arrangement of the present invention for use in mounting a different type of product, such as a torpedo level.
Figure 10:
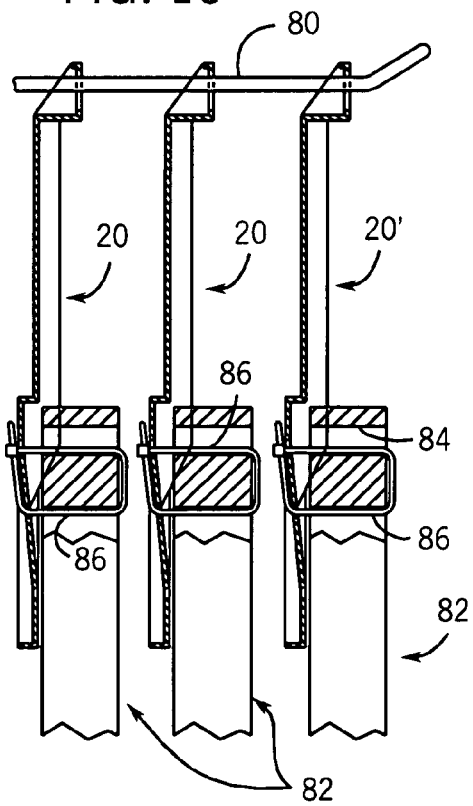
FIG. 10 is a view similar to FIG. 4, showing a number of packaging arrangements as in FIG. 9 suspended from a hook or the like for display.

FIGS. 9 and 10 illustrate that packaging arrangement 20 can be used to display other types of products, such as a torpedo level 82 having a hang hole 84. In this arrangement, the upper end of torpedo level 82 is placed against the front surface of product support section 26, and a cable tie 84 or any other satisfactory securement device is passed through hang hole 84 and through the slots of product support section 26 in order to secure torpedo level 82 to packaging arrangement 20. Again, the location of opening 76 is generally in line with the center of gravity of the packaged product, to ensure that the product hangs in a generally vertical orientation for display on hook 80. It can thus be appreciated that the same structure of packaging arrangement 20 can be used to package a variety of products, and that the only modifications required are the provision of a different card 68 for each product and a different means for engaging the product with lower product support section 26. This feature is especially well suited when displaying different products in an overall product family, to provide a common product presentation and appearance that is consistent across the entire range of products.

Figure 11:
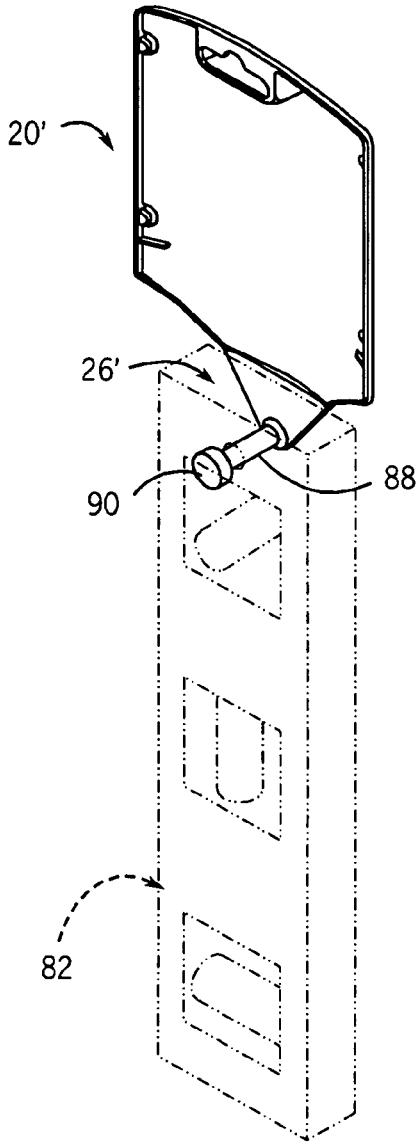
FIG. 11 is an isometric view of an alternative embodiment of a packaging arrangement in accordance with the present invention.
Figure 12:
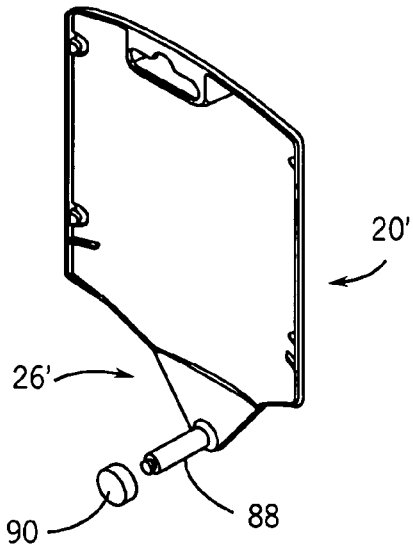
FIG. 12 is an exploded isometric view of the packaging arrangement illustrated in FIG. 11.
Figure 13:
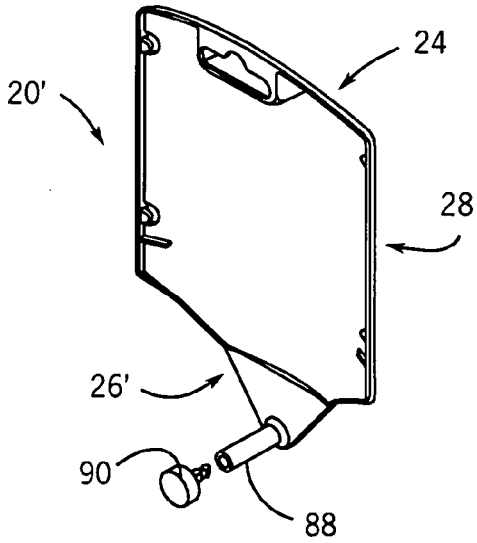
FIG. 13 is an isometric view similar to FIG. 12, showing another embodiment of a packaging arrangement in accordance with the present invention.

FIGS. 11–13 illustrate a modified packaging arrangement 22' in accordance with the present invention. In this embodiment, lower product support section 26' is formed with a post 88, which is adapted for engagement through an opening in the product, such as hang hole 84 in torpedo level 82. A cap 90 is engaged with the outer end of post 88, to maintain the product in engagement with post 88. Cap 90 may have a recess in its rear surface that receives the outer end of post 88, or may have a projection configured for engagement within a passage extending into post 88. Alternatively, post 88 may be formed so as to extend completely through hole 84 in torpedo level 82, and the outer end of post 88 may then be heated and formed to a shape similar to that of cap 90, in order to maintain torpedo level 82 in engagement with post 88. This construction eliminates the need for a separate cap member such as 90, and provides a simple and secure method of maintaining level 82 in engagement with packaging arrangement 22'. It should be understood that there are numerous other ways in which level 82 may be secured to packaging arrangement 22 or 22', and that the present invention is not limited in scope to the specific securement methods and structures shown and described.

It can thus be appreciated that the packaging arrangement of the present invention provides an offset suspension type package for displaying a product in a manner such that the product is fully exposed for handling and testing by a potential customer prior to purchase. The packaging arrangement provides maximum density of product display, while maintaining the products in a vertical orientation when displayed.

While the invention has been shown and described with respect to certain embodiments, it is understood that various alternatives and modifications are possible and are contemplated as being within the scope of the present invention. For example, and without limitation, the upper engagement area of the packaging arrangement may be suspended an any manner, and need not be by engagement of a hook within an opening. The packaging arrangement may be used to package and display any type of product, and is not limited to packaging of hand tools as shown. The specific configuration of each of the sections of the packaging arrangement may vary from the illustrated configurations, while still maintaining the same or similar overall positions of the sections relative to each other and relative to the packaged product.

Various alternatives and embodiments are contemplated as being within the scope of the following claims particularly pointing out and distinctly claiming the subject matter regarded as the invention.

We claim:

1. A suspension-type packaging and display arrangement for a product having an upper end and a lower end, comprising:

an upper suspension-type engagement section;

a lower product support section located below the upper engagement section, wherein the product is fixed to the lower support section toward the upper end of the product and is suspended from the lower product support section in a forwardly facing orientation, wherein the product and the lower product support section are configured such that the product is located forwardly of the lower product support section and is fully exposed between the upper and lower ends of the product so as to enable a potential purchaser to manipulate the product while the product is fixed to the lower product support section; and an intermediate display section located between the upper engagement section and the lower product support section, wherein the intermediate display section carries information about the product;

wherein the upper engagement section is offset in a forward direction relative to the lower product support section and is located above the product so as to maintain the packaging and display arrangement in a generally upright position when supported from the upper engagement section.

2. The packaging and display arrangement of claim 1, wherein the upper suspension-type engagement section includes an opening configured to receive a hook or the like to suspend the packaging and display arrangement therefrom.

3. The packaging and display arrangement of claim 1, wherein the intermediate display section comprises a forwardly facing wall having a pair of spaced apart side edges, wherein the side edges of the forwardly facing wall define the overall width of the packaging and display arrangement, and wherein the lower product support section and the upper engagement section are configured such that the wall is exposed therebetween.

4. The packaging and display arrangement of claim 3, wherein the information about the product is contained on a card that is engaged with the forwardly facing wall.

5. A suspension-type packaging and display arrangement for a product, comprising:

an upper suspension-type engagement section;

a lower product support section located below the upper engagement section, wherein the product is engaged with the lower product support section and is suspended therefrom in a forwardly facing orientation; and an intermediate display section located between the upper engagement section and the lower product support section, wherein the intermediate display section carries information about the product;

wherein the upper engagement section is offset in a forward direction relative to the lower product support section so as to maintain the packaging and display arrangement in a generally upright position when supported from the upper engagement section;

wherein the intermediate display section comprises a forwardly facing wall, and wherein the lower product support section and the upper engagement section are configured such that the wall is exposed therebetween, wherein the information about the product is contained on a card that is engaged with the forwardly facing wall, and wherein the intermediate display section includes a releasable engagement arrangement for releasably securing the card to the forwardly facing wall.

6. The packaging and display arrangement of claim 5, wherein the releasable engagement arrangement comprises a plurality of tab members that are spaced outwardly from a surface defined by the forwardly facing wall, wherein the tab members are configured to engage edges defined by the card for maintaining the card in engagement with the forwardly facing wall.

7. The packaging and display arrangement of claim 6, wherein the tab members are arranged to maintain the card in engagement with a forwardly facing surface defined by the outwardly facing wall.

8. The packaging and display arrangement of claim 4, wherein the card is arranged to face outwardly, and wherein the forwardly facing wall is formed of a translucent material so as to enable information contained on an inner surface defined by the card to be viewed through the material of the forwardly facing wall.

9. The packaging and display arrangement of claim 1, wherein the product support section includes an opening with which the product is engaged for securing the product to the product support section.

10. The packaging and display arrangement of claim 9, wherein the product includes engagement structure that extends into engagement within the opening for maintaining the product in engagement with the product support section.

11. The packaging and display arrangement of claim 10, wherein the product includes an opening, and wherein the product is engaged with the product support section via a retainer member that extends through the opening in the product and through the opening in the product support section.

12. The packaging and display arrangement of claim 1, wherein the product support section includes a post member that is adapted to be received within an opening associated with the product for securing the product to the product support section.

13. A package for a product, comprising:

an outwardly facing wall defining an upper area, a lower area, and a pair of spaced apart side edges extending between the upper area and the lower area;

an upper suspension-type engagement structure interconnected with the upper area of the outwardly facing wall, wherein the upper engagement structure is offset in a forward direction relative to the lower area of the outwardly facing wall;

a lower product support structure interconnected with the lower area of the outwardly facing wall, wherein the product is engaged with the lower product support structure in a manner such that the product is located forwardly of the outwardly facing wall, and wherein the outwardly facing wall between the upper engagement structure and the lower product support structure is exposed in a forward direction;

wherein the lower product support structure is configured so as to position the product such that a center of gravity defined by the product is located below the upper engagement structure so that the product and the package are suspended in a generally upright orientation; and wherein the side edges of the outwardly facing wall, located between the upper engagement structure and the lower product support structure, define the overall width of the package.

14. The package of claim 13, wherein the exposed portion of the outwardly facing wall, located between the upper engagement structure and the lower product support structure, carries information about the product, and wherein the product and the lower product support structure are configured such that the product is located forwardly of the lower product support structure and is fully exposed so as to enable a potential purchaser to manipulate the product while the product is fixed to the package.

15. The package of claim 14, wherein the information about the product is carried on a card that is engaged with the outwardly facing wall, wherein the card is exposed in a forward direction and wherein the outwardly facing wall is constructed such that information on a rearwardly facing surface of the card is visible.

16. The package of claim 15, wherein the outwardly facing wall is formed of a transparent material such that information on the rearwardly facing surface of the card is visible through the material of the outwardly facing wall.

17. The package of claim 14, wherein the upper engagement structure extends in a forward direction and includes an opening, wherein the opening is configured to receive a hook or the like to suspend the package therefrom.

18. A product package for a product having an upper end and a lower end, comprising:

a product support member defining an upper area and a lower area;

engagement means associated with the upper area of the product support member for enabling the product support member to be supported in a suspension-type manner at an upper support location;

product support means associated with the lower area of the product support member for securing the product to the product support member toward the upper end of the product, wherein the engagement means and the product support means are arranged such that the engagement means is offset in a forward direction relative to the product support means and the product is in vertical alignment with the engagement means so as to maintain the product and the package in a generally upright position when supported at the upper support location in the suspension-type manner; and display means associated with the product support member and located between the engagement means and the product support means for displaying information about the product;

wherein the product and the product support means are configured such that the product is located forwardly of the product support means and is fully exposed between the upper and lower ends of the product so as to enable a potential purchaser to manipulate the product while the product is secured to the lower product support section.

* * * * *